US006177889B1

(12) United States Patent
Grande

(10) Patent No.: US 6,177,889 B1
(45) **Date of Patent: *Jan. 23, 2001**

(54) METHOD OF CONTROLLING AT LEAST ONE TRANSIT STOP DISPLAY

(75) Inventor: Wolfgang Grande, Hintersdorf (AT)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/191,863

(22) Filed: Nov. 12, 1998

(30) Foreign Application Priority Data

Nov. 27, 1997 (DE) ..... 197 52 460

(51) Int. Cl.[7] ..... G08G 1/123
(52) U.S. Cl. ..... 340/994; 340/991
(58) Field of Search ..... 340/994, 991, 340/992, 993, 989, 988; 701/117

(56) References Cited

U.S. PATENT DOCUMENTS

| | | | | |
|---|---|---|---|---|
| 4,533,871 | | 8/1985 | Boetzkes | 324/207 |
| 4,799,162 | * | 1/1989 | Shinkawa et al. | 340/994 |
| 4,857,925 | * | 8/1989 | Brubaker | 340/994 |
| 5,613,216 | | 3/1997 | Galler | 340/994 |
| 5,736,940 | * | 4/1998 | Burgener | 340/994 |
| 5,774,072 | * | 6/1998 | Wu | 340/994 |

FOREIGN PATENT DOCUMENTS

| | | |
|---|---|---|
| 4003753 | 8/1991 | (DE) . |
| 2178210 | 2/1987 | (GB) . |
| 9313510 | 7/1993 | (WO) . |

OTHER PUBLICATIONS

Patent Abstracts of Japan 10–011699 Jan. 16, 1998, for Japanese Pat. Appl. 08–181622, filed Jun. 24, 1996.
Patent Abstracts of Japan 07–334796, Dec. 22, 1995, for Japanese Pat. Appl. 06–125970 filed Jun. 08, 1994.
Patent Abstracts of Japan 08–329388, Dec. 13, 1996 for Japanese Pat. Appl. 07–130159, filed May 29, 1995.

* cited by examiner

*Primary Examiner*—Brent A. Swarthout

(57) ABSTRACT

The invention concerns a method of controlling at least one transit stop display (1), whereby a vehicle (6) transmits its identification signal and its current location data to a control center (3), which calculates the estimated waiting time (5) until the vehicle (6) arrives at least at one stop (2), and controls the stop display (1) associated with to the respective stop (2) for the visual display of this waiting time (5). To ensure that a switch-over or switch-off of the waiting time display takes place in the vicinity of the stop (2), it is provided that the vehicle (6) transmits a blanking message (9) with a small range $x_1$, for example 100 meters, which triggers a switch-over of the stop display (1) to blanking (5*a*), when the vehicle (6) approaches the stop (2) within a distance of $x_2 \leqq x_1$.

5 Claims, 1 Drawing Sheet

METHOD OF CONTROLLING AT LEAST ONE TRANSIT STOP DISPLAY

BACKGROUND OF THE INVENTION

1. Technical Field

The invention concerns a method of controlling at least one transit stop display and a control system.

2. Discussion of Related Art

The estimated waiting time until the next vehicle (bus, streetcar) of a predetermined line arrives, is signalled to the user of the local public passenger transit by transit stop displays. This requires performing a switch-over or switch-off of the waiting time display when the vehicle's distance from the stop is under 100 meters. The radio control of the transit stop displays by the control center is not suitable for that purpose because the error tolerances are too large, particularly those which determine the location data of the vehicle. With a waiting time display that is controlled in intervals of one minute, it can therefore happen that a remaining waiting time of 1 minute is signalled when the vehicle has already reached the stop.

Roadway-inserted induction loops are known, which can be used to trigger actions when they are passed over. However in the case of a transit stop display control, considerable hardware and software problems would occur since vehicles from different lines must be differentiated.

The use of a remote radio control such as is used for the priority switch-over of a traffic light is also linked to considerable drawbacks. The vehicles must be equipped with corresponding transmitters and the transit stop displays with suitable receivers. Furthermore this does not solve the problem of the correct trigger time for the emission of the infrared signal.

SUMMARY OF INVENTION

The object of the invention is to present a method and a control system of the aforementioned type which simply and reliably and with sufficient accuracy ensure a switch-over or switch-off of the waiting time display in the vicinity of the stop.

According to the invention, a method of controlling at least one transit stop display, whereby a vehicle transmits an identification signal and current location data to a control center, which calculates an estimated waiting time until the vehicle arrives at least at one stop, and controls the display associated with the respective stop in regard to the visual display of this waiting time, is characterized in that the vehicle transmits a blanking message having a selected range $x_1$ which triggers a switch-over of the stop display to blanking when the vehicle approaches the stop within a distance of $x_2 \leqq x_1$.

The invention is based on the knowledge that by superimposing a direct control, which is triggered by the vehicle, over the central control of the transit stop display, tolerances and inaccuracies can be eliminated. The passenger no longer receives erroneous information from a still displayed waiting time when the vehicle has already reached the stop.

In further accord with the present invention, the central station generates radio datagrams having a structure and length for controlling display panels of the stop display that are assigned to lines, where a window is provided between the radio datagrams during which the vehicle sends the blanking message. In that case, the vehicle transmits the blanking message during the transmission pauses between the radio datagrams which are generated by the control center. This avoids the simultaneous reception by the stop display of radio signals from the control center and from the vehicle. The emission of a vehicle signal that is heavily dominant with respect to the radio datagram of the control center could also be imagined, so that the blanking message is detected in all instances.

This window variation significantly facilitates the synchronization in time of the vehicle signal by transmitting the window message at the end of each radio-datagram. The window message signals to the vehicle that a window, namely a transmission pause, follows immediately and that the blanking message can be sent. This provides the advantage that the lengths of the radio datagrams must not necessarily be constant. The window length can also vary, provided that its length is sufficient to transmit the blanking message.

Preferably a blanking message is only generated if a stop is next in line, i.e., if the vehicle comes within a distance $x_3$ of the station 2 where $x_3 > x$. For reasons of safety the distance $x_3$ which the vehicle ascertains by means of a relatively coarse location determination, is much longer than the range $x_1$ of the blanking message. This provides advantages and savings, particularly for stops located far apart, since the blanking message is only transmitted with a certain probability that a stop even exists in the vicinity.

A control system having a simple and economical construction locates the transmission device in the vehicle for transmitting the identification signal and the current location data of the vehicle to the control center, wherein the transmission device is also able to transmit the blanking message. A transmission installation, which is provided anyway in the vehicle for communication with the control center, simultaneously assumes the function of controlling the display. No additional equipment is required in the vehicle nor in the stop display.

BRIEF DESCRIPTION OF THE DRAWING

The invention will be explained in more detail in the following by means of two figures, wherein.

DETAILED DESCRIPTION OF PREFERRED EMBODIMENTS

Figure 1A:
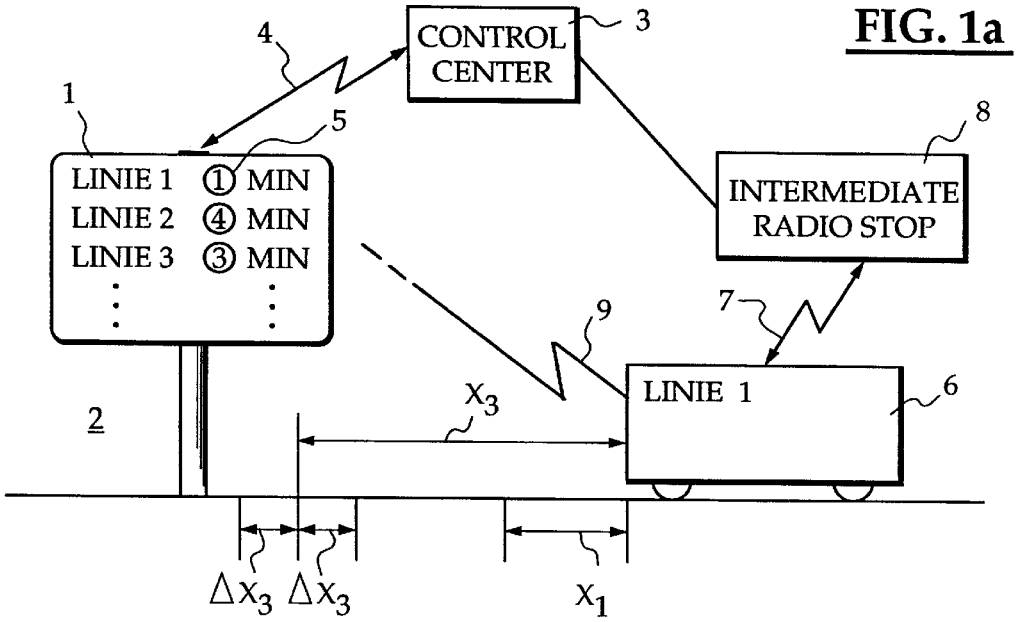
FIGS. 1*a* and 1*b* are schematic depictions to illustrate a method of controlling a transit stop display.
Figure 1B:
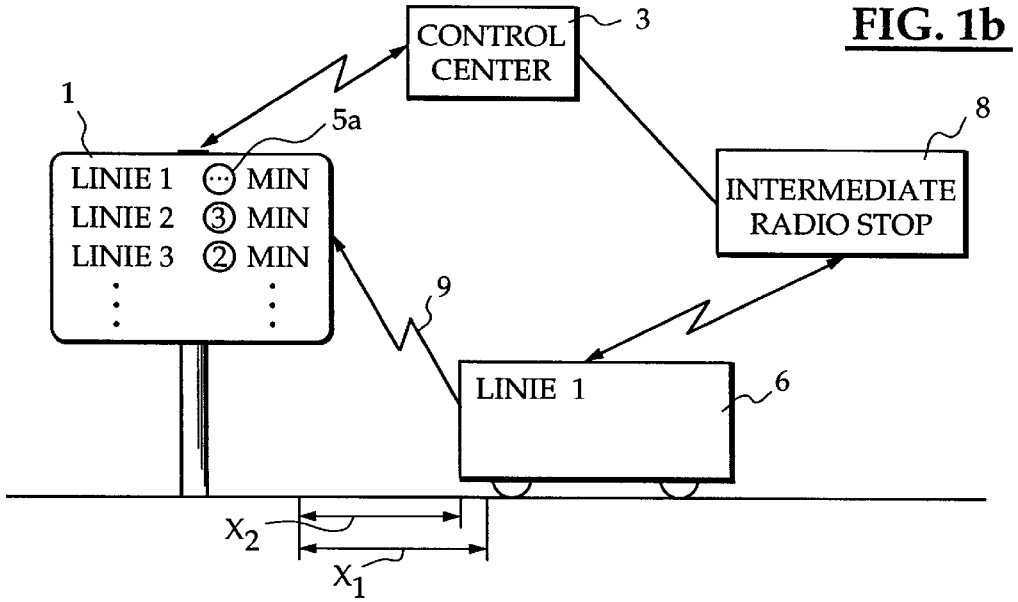

FIGS. 1*a* and 1*b* illustrate a stop display 1 at a transit stop 2, which is controlled by a control center 3 with radio datagrams 4 that signal the estimated waiting time 5 for vehicles from different lines. To that end, the vehicle 6 transmits its coordinates via a radio connection 7 to an intermediate stop 8 which interacts with the control center 3. From the current location data of the vehicle 6 and the known coordinates of the stop 2, the control center 3 determines the estimated remaining travel time which corresponds to the waiting time 5 to be displayed. When the distance of the vehicle 6 from the stop 2 falls below a predetermined value $x_3$, the vehicle starts to transmit a blanking message 9 which has a range $x_1$ that is less than the distance $x_3$. In that case the distance $x_3$ can be chosen to be much greater than the range $x_1$ of the blanking message, to ensure that the uncertainty $\Delta x_3$ of the distance (i.e., margin of error) always allows the blanking message to be transmitted at the right time.

FIG. 1*b* illustrates the location of a vehicle 6 where a switch-over of the waiting time display 5 to blanking 5*a* is triggered by a blanking message 9. The range $x_1$ of the blanking message is somewhat larger than the switch-over distance $x_2$ of the vehicle 6 from the stop 2. The time delay between $x_1$ and $x_2$ is a result of the structure of the radio datagrams 4 generated by the control center 3.

Figure 2:
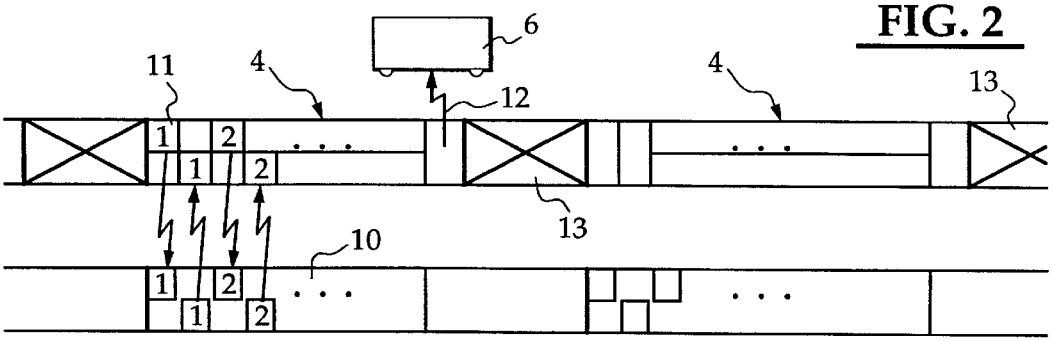
FIG. 2 is a schematic configuration of the interaction of a radio datagram with a stop display and a vehicle.

FIG. 2 illustrates the structural setup of a radio datagram 4 interacting with a handshake device 10 of the stop display 1 and the vehicle 6. The radio datagram 4 essentially comprises data sets 11 provided to show the waiting time (5) on the stop display 1, and a window message 12 to mark the end of the radio datagram. The window message 12 is received by the vehicle 6; this triggers a command to transmit the blanking message 9 to the stop display 1. The window message 12 synchronizes the blanking message 9 with the radio datagram 4 so that a transmission can only take place during a transmission pause, meaning a window 13 between radio datagrams 4. This synchronization can result in a difference between the distance $x_2$ of vehicle 6 at the stop 2 generating the blanking message 9, and the range $x_1$ of blanking message 9.

At the location illustrated in FIG. 1*b*, the waiting time display 5 for the next vehicle 6 of line 1 was just switched over to blanking 5a.

The invention is not restricted to the embodiment indicated above. Rather a number of variations can be envisioned, which can make use of the features of the invention even with a basic change in the configuration.

What is claimed is:

1. A method of controlling at least one transit stop display (1), whereby a vehicle (6) transmits an identification signal and current location data to a control center (3), which calculates an estimated waiting time (5) until the vehicle (6) arrives at least at one stop (2), and controls the display (1) associated with the respective stop (2) in regard to the visual display of this waiting time (5), characterized in that the vehicle (6) transmits without receipt of a sense identification signal from the respective stop a blanking message (9) having a selected range $x_1$ which triggers a switch-over of the stop display (1) to blanking (5a) when the vehicle (6) approaches the stop (2) within a distance of $x_2 \leqq x_1$.

2. A method as claimed in claim 1, characterized in that the control center (3) generates radio datagrams (4) having a structure and length for controlling display panels of the stop display (1) where a window (13) is provided between the radio datagrams (4) during which the vehicle (6) sends the blanking message (9).

3. A method as claimed in claim 2, characterized in that a window message (12) generated by the control center (3) is transmitted to the vehicle (6) from the control center (3) during the window (13) at the end of each radio datagram (4).

4. A method as claimed in claim 1, characterized in that the blanking message (9) is only sent if the vehicle is less than a distance $x_3$ from the stop (2) where $x_3 > x_1$.

5. A control system as claimed in claim 1, characterized in that a transmission device having both low power and high power transmission modes located in the vehicle (6) for transmitting the identification signal and the current location data of the vehicle (6) to the control center (3) with high power, is also able to transmit the blanking message (9) with low power.

* * * * *